US006802170B2

(12) United States Patent
Davis

(10) Patent No.: US 6,802,170 B2
(45) Date of Patent: Oct. 12, 2004

(54) BOX BEAM AND METHOD FOR FABRICATING SAME

(76) Inventor: Kurt K. Davis, 2323 Fern St. #1, Honolulu, HI (US) 96826

( * ) Notice: Subject to any disclaimer, the term of this patent is extended or adjusted under 35 U.S.C. 154(b) by 0 days.

(21) Appl. No.: 10/337,520

(22) Filed: Jan. 7, 2003

(65) Prior Publication Data

US 2003/0126827 A1 Jul. 10, 2003

Related U.S. Application Data

(60) Provisional application No. 60/344,812, filed on Jan. 7, 2002.

(51) Int. Cl.[7] ..... E04C 3/30

(52) U.S. Cl. ..... 52/731.2; 52/731.3; 52/732.6; 52/732.1; 52/730.1; 29/897.31

(58) Field of Search ..... 52/731.2, 731.3, 52/732.2, 737.6, 732.1, 730.1; 29/897.31

(56) References Cited

U.S. PATENT DOCUMENTS

| | | | | |
|---|---|---|---|---|
| 768,594 A | | 8/1904 | Finlay | |
| 1,331,247 A | | 2/1920 | Daniels | |
| 1,335,609 A | | 3/1920 | Schneller | |
| 1,997,876 A | * | 4/1935 | Sheldon | 52/731.2 |
| 2,029,645 A | | 2/1936 | Waugh | |
| 2,039,398 A | | 5/1936 | Dye | |
| 2,167,835 A | | 8/1939 | Greulich | |
| 2,389,573 A | | 11/1945 | Balduf | |
| 2,916,111 A | | 12/1959 | Pleitgen et al. | |
| 3,332,197 A | * | 7/1967 | Hinkle | 52/731.3 |
| 4,069,638 A | | 1/1978 | Hasselqvist et al. | |
| 4,272,073 A | | 6/1981 | Grosser et al. | |
| 4,424,652 A | | 1/1984 | Turner | |
| 4,793,113 A | | 12/1988 | Bodnar | |
| 5,014,487 A | * | 5/1991 | King | 52/731.2 |
| 5,426,906 A | | 6/1995 | McCracken | |
| 5,588,273 A | | 12/1996 | Csagoly | |
| 5,625,997 A | | 5/1997 | Callahan et al. | |
| 5,661,945 A | | 9/1997 | Henriksson et al. | |
| 5,687,538 A | | 11/1997 | Frobosilo et al. | |
| 5,692,353 A | | 12/1997 | Bass et al. | |
| 5,842,318 A | | 12/1998 | Bass et al. | |
| 5,848,512 A | | 12/1998 | Conn | |
| 5,904,025 A | | 5/1999 | Bass et al. | |
| 6,131,362 A | | 10/2000 | Buecker | |
| 6,145,270 A | | 11/2000 | Hillman | |
| 6,151,858 A | | 11/2000 | Ruiz et al. | |
| 6,170,217 B1 | | 1/2001 | Meyer | |
| 6,296,287 B1 | * | 10/2001 | Kinbara et al. | 293/120 |
| 6,415,576 B1 | * | 7/2002 | Stromback | 52/719 |

FOREIGN PATENT DOCUMENTS

| | | |
|---|---|---|
| FR | 1048852 | 8/1953 |
| WO | WO9801549 | 2/1989 |
| WO | WO9117328 | 11/1991 |

* cited by examiner

*Primary Examiner*—Laurie K. Cranmer
(74) *Attorney, Agent, or Firm*—Krieg DeVault Lundy LLP

(57) ABSTRACT

A box beam is provided that may be fabricated to any desired size, having a box-like structure defined by a seam defined by spaced apart first and second allowance ends or other connection means configuration, first and second top portions, first and second side portions, and a bottom portion, the bottom portion having a raised ridge formed midway about its width and running substantially along the length of the box beam. A method is also provided for fabricating the various embodiments of the box beam described from sheet metal, namely, forming the ridge, turning up the allowance ends at about right angles to the sheet, turning up the top portions likewise, then turning up the side portions likewise.

31 Claims, 5 Drawing Sheets

BOX BEAM AND METHOD FOR FABRICATING SAME

This application claims priority based on U.S. Provisional Patent Application Ser. No. 60/344,812, entitled "Universal Light Steel Beam", and filed Jan. 7, 2002.

DETAILED DESCRIPTION OF EMBODIMENTS OF THE INVENTION

Figure 1:
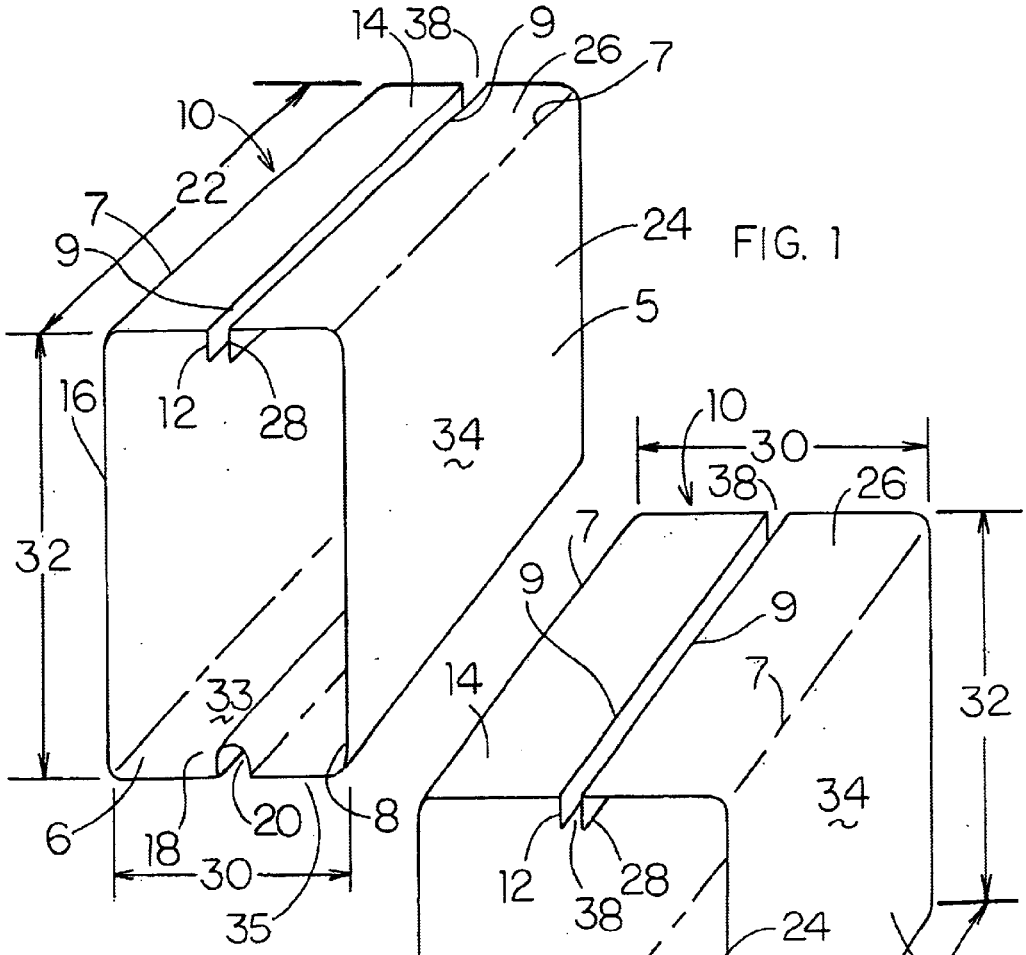
FIG. 1 is a perspective view of one embodiment of a box beam according to the present invention.
Figure 2:
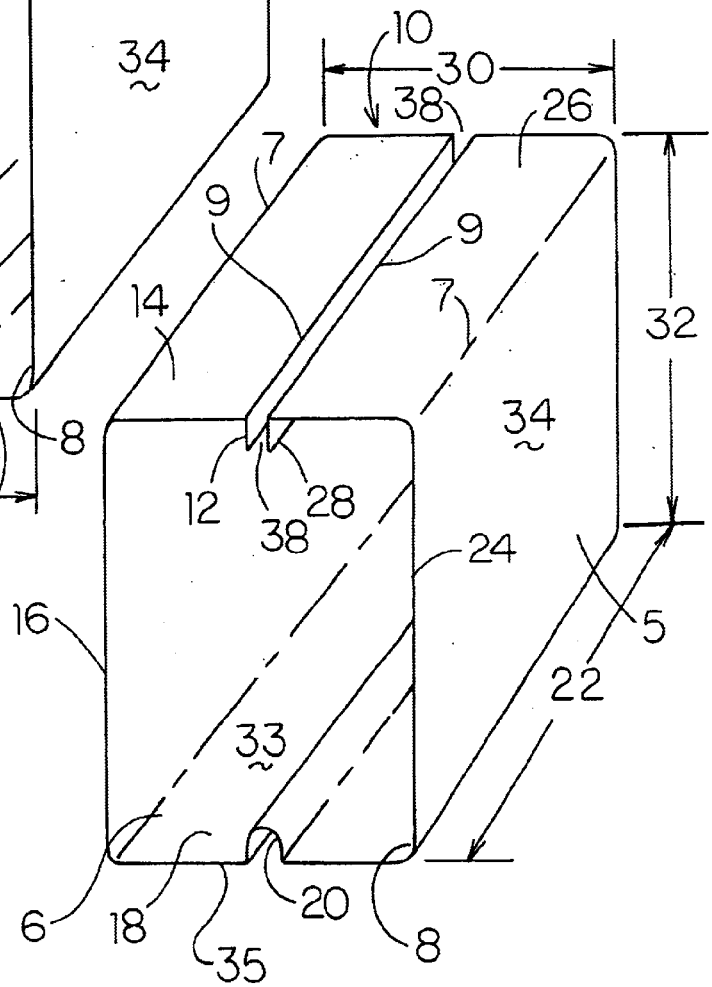
FIG. 2 is a perspective view of another embodiment of box beam according to the present invention having dimensions different from the box beam of FIG. 1.

Referring now to FIGS. 1 and 2, embodiments of a box beam 10 are provided having a substantially continuous outer surface 5 defined by first and second side portions 16, 24, a bottom portion 18, and first and second top portions 14, 26 that are substantially coplanar and spaced apart by a seam 38. A ridge 20 is provided along the length 22 of the box beam 10 in the bottom portion 18 generally midway between the side portions 16, 24. First and second seam allowance ends 12, 28 are provided depending from the top portions 14, 26, respectively. In one embodiment, the box beam 10 is fabricated of sheet metal 34. In other embodiments, the box beam 10 is fabricated of cold rolled sheet steel. In yet other embodiments, the sheet steel is galvanized.

Figure 7:
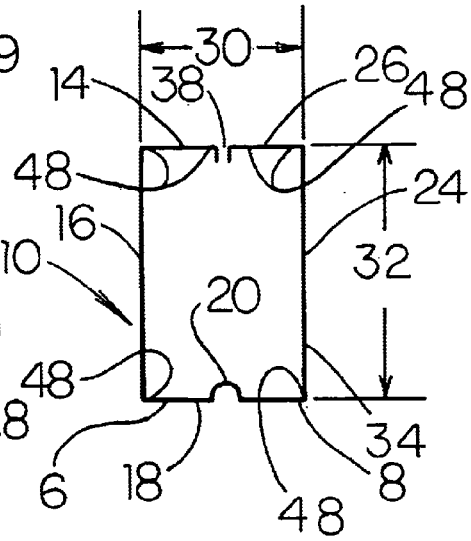
FIG. 7 is an end view of the sheet metal of FIG. 6 showing the first and second side portions turned up at about right angles to the sheet metal and spaced apart about the bottom portion of the box beam.

As shown in FIGS. 1, 2 and 7, the allowance ends 12, 28 and the side portions 16, 24 each depend from opposite edges 7, 9 of the top portions 14, 26, respectively, in substantially a common direction and at about right angles to the top portions. The side portions 16, 24 extend between the top portions 14, 26, respectively, and the bottom portion 18. The side portions 16, 24 are connected to the bottom portion 18 at about right angles thereto and respectively at opposite ends 6, 8 thereof. The bottom portion 18 is generally parallel with the top portions 14, 26. The ridge 20 provided in the bottom portion 18 is raised generally toward the top portions 14, 26.

As shown in FIGS. 1 and 2, the outer surface 5 of the box beam 10 is substantially continuous. The first allowance end 12 abuts the second allowance end 28 to define a seam 38. In one embodiment, the first allowance end 12 and the second allowance end 28 are spaced apart a distance up to ½ inch. The first top portion 14 extends from the first allowance end 12 at about a right angle. The first side portion 16 extends at about a right angle from the first top portion 14 on the edge 7 of the first top portion opposite the edge 9 connected to the first allowance end 12. The bottom portion 18 extends at about a right angle from the first side portion 16 on the edge of the first side portion opposite the first top portion 14. The ridge 20 is formed in the bottom portion 18 along the length 22 of the box beam 10 approximately midway about the width 30 of the box beam at the bottom portion. The second side portion 24 extends at about a right angle from the bottom portion 18 on the end 8 of the bottom portion opposite the first side portion 16. The second top portion 26 extends at about a right angle from the second side portion 24 on the edge of the second side portion opposite the bottom portion 18. The second allowance end 28 extends at about a right angle from the second top portion 26 on the edge 9 of the second top portion opposite the edge 7 connected to the second side portion 24.

The length 22, width 30 and height 32 dimensions of the box beam 10 may be cut to size prior to fabrication of the box beam. In one embodiment, the box beam 10 is fabricated at the site of its intended use once the required dimensions 22, 30, 32 are determined. In other embodiments, the height 32 and width 30 of the box beam 10 are set by the position of the bends 48 formed by a break press (not shown) or roll press (not shown) in the sheet metal 34 for fabricating the box beam. A break press or roll press may be powered by electrical, hydraulic or pneumatic means. In yet other embodiments, the box beam 10 is fabricated away from the site of intended use and is transported to the site as desired.

In one embodiment, during fabrication of a box beam 10, bends 48 are formed in the sheet metal 34 by turning up one portion of the box beam relative to another until the angle between them is about a right angle (90 degrees). In other embodiments, the internal radius of each bend 48 so formed is about 1½ times the thickness 36 of the sheet metal 34.

In one embodiment, the sheet metal 34 is of a standard thickness 34 having a selected gauge. In other embodiments, the gauge thickness of the sheet metal 34 is from about 10-gauge to about 20-gauge. Gauge thickness may be selected according to the structural requirements for the box beam 10 manufactured according to the embodiments of the present invention.

Figure 8:
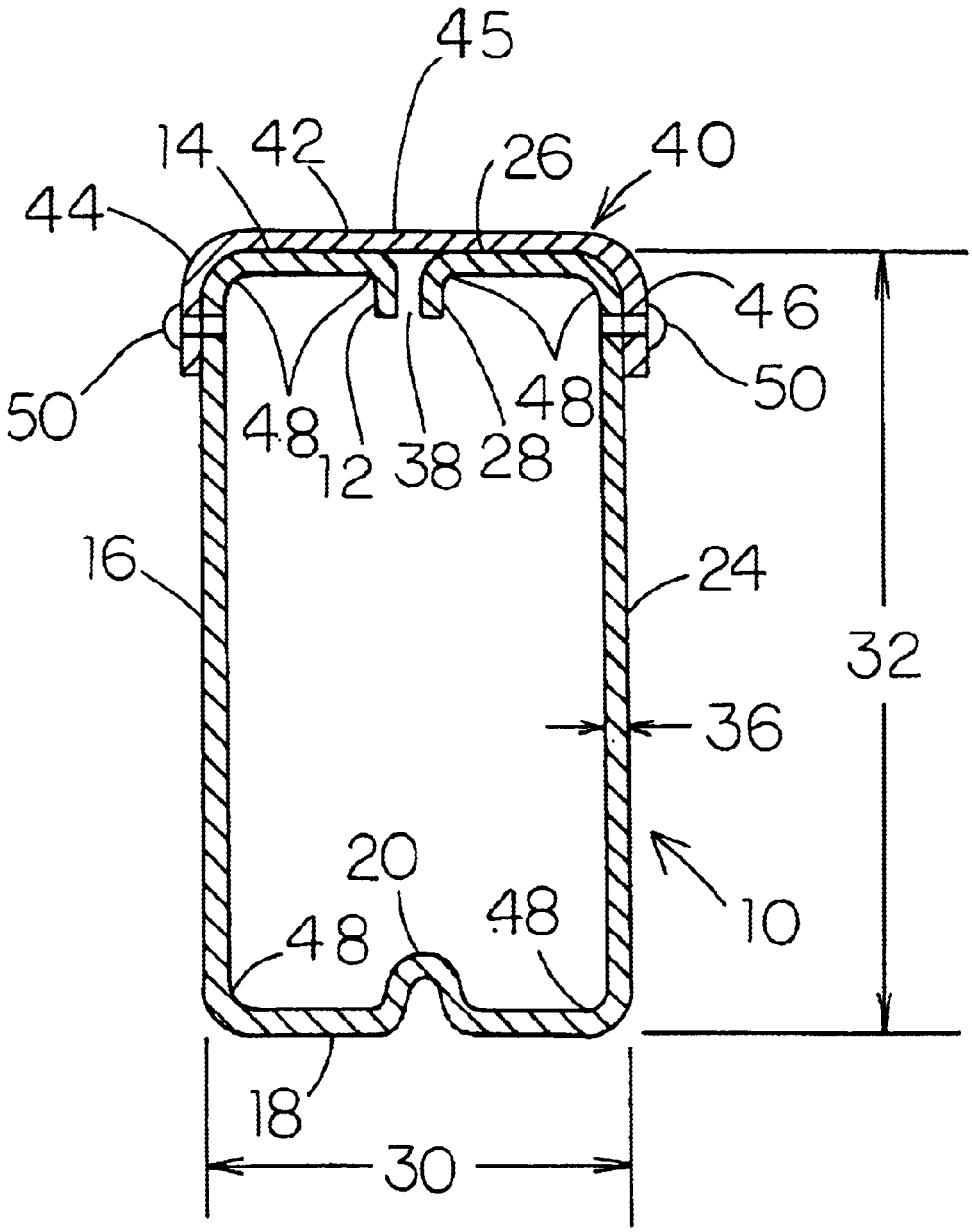
FIG. 8 illustrates an embodiment of the box beam of the present invention having an optional U-shaped track for securement of the box beam at the top portions.
Figure 13:
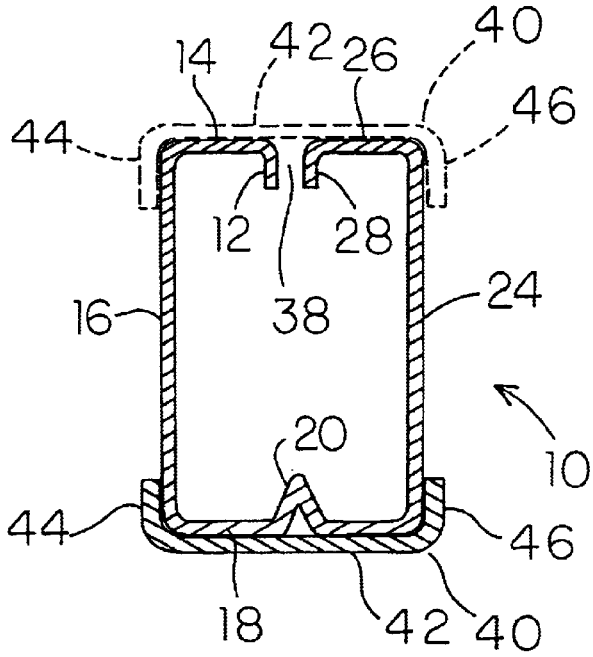
FIG. 13 illustrates a cross sectional view of an embodiment of the box beam of the present invention having an optional U-shaped track for securement to the box beam at the bottom portion, and illustrating in dashed line a U-shaped track for securement to the box beam at the top portions.
Figure 14:
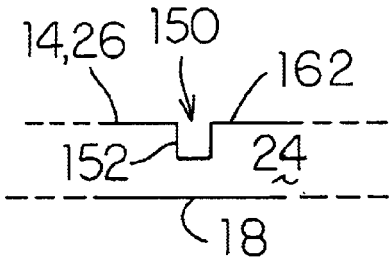
FIG. 14 illustrates a partial side view of an embodiment of the box beam of the present invention having a structural element comprising a notch incorporated in a medial portion of the box beam.
Figure 15:
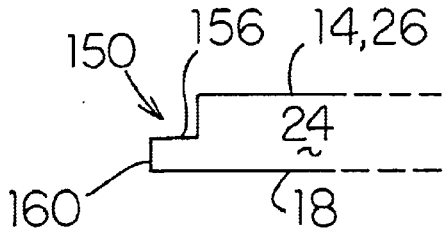
FIG. 15 illustrates a partial side view of an end of an embodiment of the box beam having a structural element comprising a seat cut incorporated therein.
Figure 16:
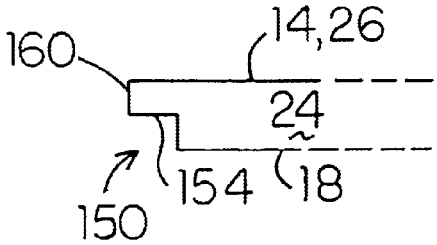
FIG. 16 illustrates a partial side view of an end of an embodiment of the box beam having a structural element comprising a tail cut incorporated therein.
Figure 17:
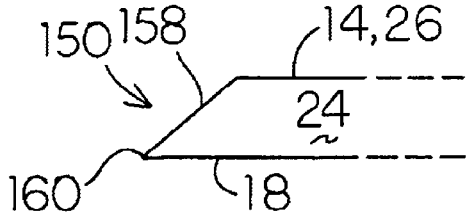
FIG. 17 illustrates a partial side view of an end of an embodiment of the box beam having a structural element comprising an angled butt joint incorporated therein.

As shown in FIG. 8, a U-shaped track 40 may be provided to stabilize the box beam 10. In one embodiment, the U-shaped track 40 has a top portion 42 and first and second depending side portions 44, 46 configured to receive the box beam 10 as described herein. In other embodiments, a U-shaped track 40 is secured to the box beam 10 at the first and second top portions 14, 26 and covers the seam 38. In yet other embodiments, a U-shaped track 40 is secured to the box beam 10 at the bottom portion 18 and covers the underside of the ridge 20 as shown in FIG. 13. In any embodiment, a U-shaped track 40 may be secured at one or both of the top portions 14, 26 and bottom portion 18. In yet other embodiments, the U-shaped track 40 is secured to the box beam 10 using conventional fastening means 50, such as screws, rivets, adhesives, clamps and welding, affixed between the first and second depending side portions 44, 46 and the first and second side portions 16, 24 of the box beam 10, respectively.

Figure 9:
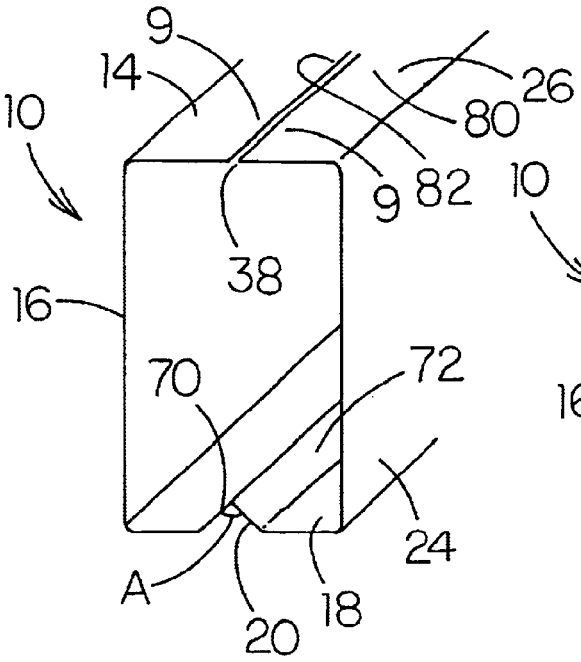
FIG. 9 illustrates an alternative embodiment of the box beam having a seam defined by top portion ends secured together without allowance ends.
Figure 10:
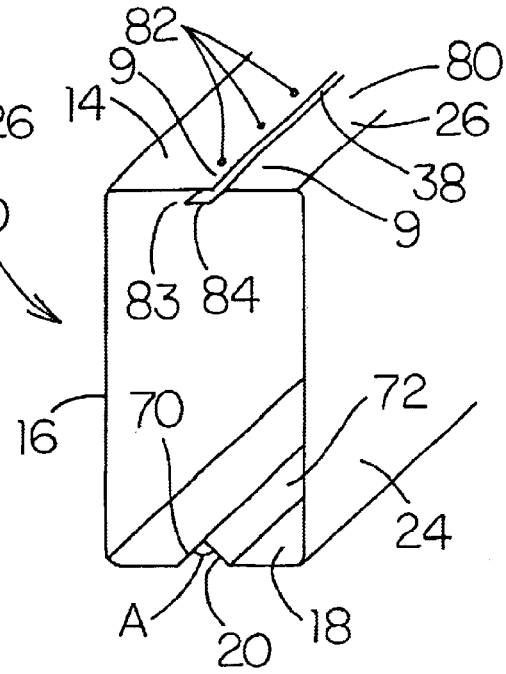
FIG. 10 illustrates an alternative embodiment of the box beam having a seam defined by top portions connected by an overlap joint, and shows a wide ridge configuration in the bottom portion.
Figure 11:
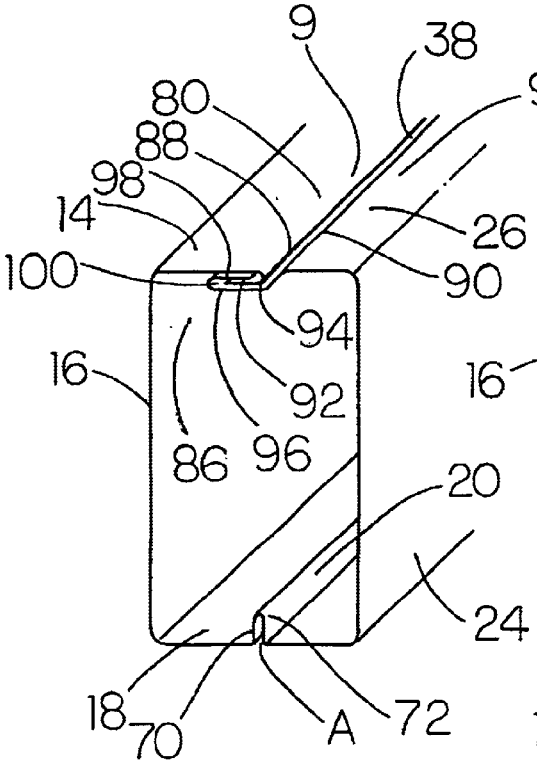
FIG. 11 illustrates an alternative embodiment of the box beam having a seam defined by an interlocking tongue and groove joint, and shows a narrow ridge configuration in the bottom portion.
Figure 12:
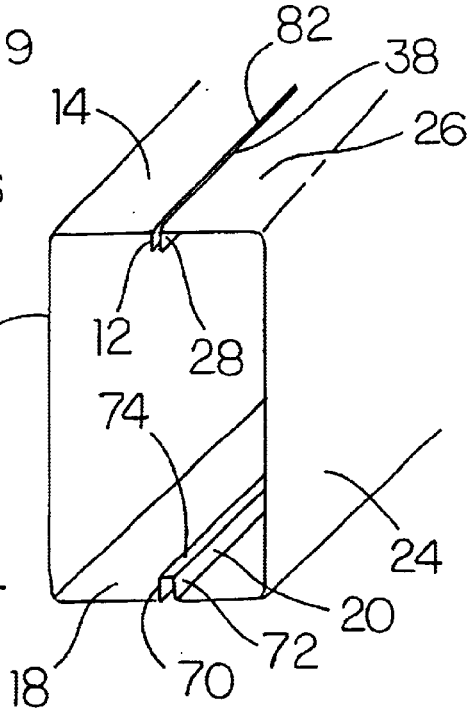
FIG. 12 illustrates an alternative embodiment of the box beam having a box-like ridge configuration.

As shown in FIGS. 9–11, alternative embodiments of the box beam 10 obviate the need for the U-shaped track 40. Generally, these embodiments utilize various connection means 80 for securing the first and second top portions 14, 26 without use of first and second allowance ends. In addition, the U-shaped track 40 may be obviated for the embodiments of the box beam 10 shown in FIGS. 1, 2 and 7 by either spot or continuous welding applied at the seam 38, as shown in FIG. 12.

Referring now to FIG. 9, box beam 10 is provided without allowance ends. Connection means 80 for securing the first and second top portions 14, 26 comprises top portions 14, 26 being abutted at their respective edges 9, to define the seam 38 and either spot or continuous welding 82 applied substantially along the length of the seam.

Referring now to FIG. 10, box beam 10 is again provided without allowance ends. Connection means 80 for securing the first and second top portions 14, 26 comprises an overlap joint 83 defining the seam 38 wherein the second top portion 26 comprises a recessed lip 84 extending from its inner edge 9. The lip 84 is configured to receive the inner edge 9 of the first top portion 14. In one embodiment, spot or continuous welding 82 is applied substantially along the length of the overlap joint 83. In other embodiments, lip 84 extends from edge 9 at least ½ inch.

Referring now to FIG. 11, box beam 10 is again provided without allowance ends. Connection means 80 for securing the first and second top portions 14, 26 comprises an interlocking tongue and groove joint 86 defining the seam 38. The first top portion 14 comprises a male tongue and groove end 88 at its inner edge 9, and the second top portion 26 comprises a female tongue and grove end 90 at its respective inner edge 9. Male tongue and groove end 88 comprises a first hairpin lip 92 extending from the inner edge 9 of the first top portion 14 downwardly and backwardly beneath the first top portion to define groove 94. Female tongue and groove end 90 comprises a recessed lip 96 extending from the respective inner edge 9 of the second top portion 26 to a second hairpin lip 98 extending upwardly and backwardly above the recessed lip to define groove 100. Groove 94 is configured to receive the second hairpin lip 98. Groove 100 is configured to receive the first hairpin lip 92. In one embodiment, first and second hairpin lips 92, 98 respectively extend backwardly at least about ½ inch.

Conventional box beams are fabricated in widths of between about 2 inches and about 6 inches, according to standard wall thicknesses. Conventional box beams are also fabricated in heights of 6 inches, 8 inches, 10 inches, 12 inches, 14 inches and 16 inches, according to preference and structural purpose. Conventional box beams are additionally fabricated in lengths from several inches to several feet, according to preference and structural placement of the box beam. The embodiments of the box beam 10 of the present invention may conform to conventional determinations of dimensions of width, height and length. Regardless of dimension 22, 30, 32, the steps for fabricating embodiments of the box beam 10 disclosed herein remain generally the same.

Figure 3:
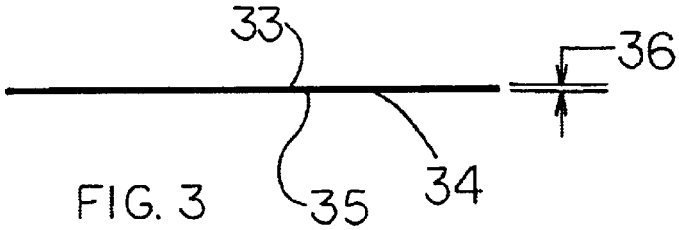
FIG. 3 is an end view of a piece of sheet metal cut to width prior to fabrication into a box beam in accordance with the embodiments of the invention.

A method for fabricating a box beam 10 from sheet metal 34 is shown in FIGS. 3–7. Referring first to FIG. 3, a piece of sheet metal 34 is selected having gauge thickness desired and is cut to size according to the dimensions 22, 30, 32 required. In one embodiment, cutting the sheet metal 34 is performed using a shear or other conventional cutting tool (not shown).

Figure 4:
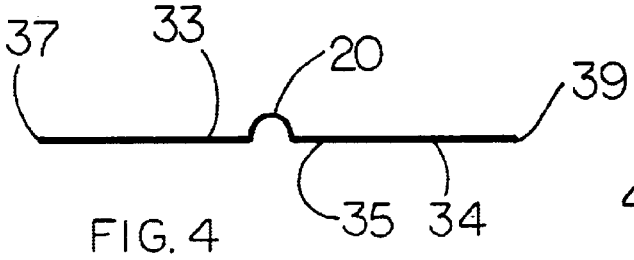
FIG. 4 is an end view of the piece of sheet metal of FIG. 3 with a ridge formed along the length of the sheet metal.

Referring to FIG. 4, the ridge 20 is formed along the length 22 of the sheet metal 34 generally midway about the width 30 thereof. The ridge 20 is raised from the sheet metal 34 a distance from about ¼ inch to about 1 inch. The ridge configuration may be determined in accordance with strength requirements for the box beam 10 and tooling and equipment available. In one embodiment, the ridge 20 is formed by clamping the sheet metal 34 between a suitable conventional male die or roll former (not shown) positioned on one side 33 of the sheet metal 34 and a corresponding female die or roll former (not shown) positioned on the opposite side 35 of the sheet metal. In other embodiments, the ridge 20 has a wide configuration, as shown in FIG. 10. The angle A between the first side 70 and the second side 72 of the ridge 20 is between about 45 degrees and about 85 degrees in the wide ridge configuration. In yet other embodiments, the ridge 20 has a narrow configuration, as shown in FIG. 11. The angle A between the first side 70 and the second side 72 of the ridge 20 is less than about 45 degrees in the narrow ridge configuration. In yet other embodiments, the ridge 20 has a box-like configuration, as shown in FIG. 12. In the box-like configuration, the first side 70 and second side 72 are raised from the bottom portion 18 at about right angles thereto and extend to a ridge top 74 that connects first side 70 to second side 72 at about right angles to each. In any configuration, the width of the ridge 20 in the plane of the bottom portion 18 is between about 0 inches and about 1 inch.

Figure 5:
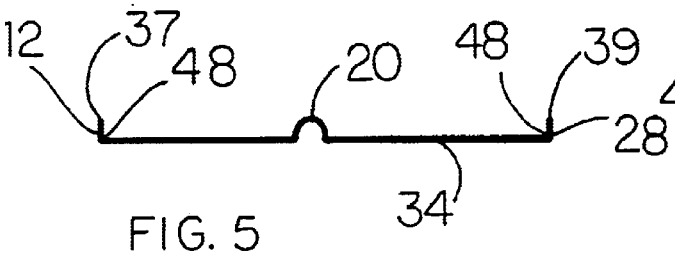
FIG. 5 is an end view of the piece of sheet metal of FIG. 4 showing the ends turned up at about right angles to the sheet metal.

Referring now to FIG. 5, first and second allowance ends 12, 28 are formed by turning up the opposite ends 37, 39 of the sheet metal 34 at about right angles thereto along the length 22 thereof. The opposite ends 37, 39 are turned up generally equidistantly. In one embodiment, the allowance ends 12, 28 so formed are turned up not more than about 1 inch.

Figure 6:
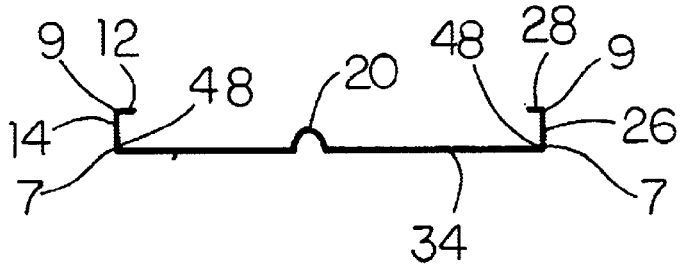
FIG. 6 is an end view of the piece of sheet metal of FIG. 5 showing the first and second top portions turned up at about right angles to the sheet metal.

Referring now to FIG. 6, first and second top portions 14, 26 are formed by turning up portions of the sheet metal 34 adjacent the formed allowance ends 12, 28 respectively, at about right angles from the sheet metal. In one embodiment, the turned up portions for the first and second top portions 14, 26 measure a distance equal to or less than about ½ the width 30 desired for the box beam 10.

Referring now to FIG. 7, first and second side portions 16, 24 are formed by turning up portions of the sheet metal 34 adjacent the formed top portions 14, 26, respectively, at about right angles from the sheet metal. In one embodiment, the turned up portions for the side portions 16, 24 are spaced apart along the sheet metal 34 about the width 30 desired for the box beam 10. In other embodiments, the sheet metal 34 extending between the side portions 16, 24 comprises the bottom portion 18 of the box beam 10. In yet other embodiments, the ridge 20 is generally centered between the side portions 16, 24 on the bottom portion 18.

It is within the scope of this disclosure to combine any of these steps or to isolate portions of a step to accommodate available equipment or otherwise incorporate efficiency techniques to the overall fabrication of an embodiment of a box beam 10 according to the present invention, including modifications to these steps to fabricate the alternative embodiments shown in FIGS. 9–11.

Referring now to FIGS. 14–17, in one embodiment, structural elements 150 particular to the use of an embodiment of the box beam disclosed herein for construction of structures are incorporated in the design of the box beam 10. In other embodiments, notches 152, tail cuts 154, seat cuts 156, and angled butt joints 158 are incorporated into an end 160 of the box beam 10 or into a medial portion 162 thereof along its longitudinal length. In yet other embodiments, such structural elements 150 are incorporated into the box beam 10 during fabrication by cutting or otherwise forming them into the sheet metal 34 at the desired locations.

Referring now to FIG. 8, a U-shaped track 40 may be fabricated utilizing steps and equipment similar to the steps and equipment utilized to fabricate the box beam 10. In one embodiment, the U-shaped track 40 is fabricated from a selected second piece of sheet metal 45 having length generally the same as the length 22 of the box beam 10 to which it is to be secured. In other embodiments, the width of the U-shaped track 40 is no greater than approximately the desired width 30 for the box beam 10 plus the height 32 of one of the side portions 16, 24. The U-shaped track 40 is fabricated from this second piece 45 by turning up first and second depending side portions 44, 46 at about right angles to the second piece of sheet metal 45 along the length thereof. The depending side portions 44, 46 in one embodiment are turned up generally equidistantly and sufficiently to space the depending side portions apart along the second piece of sheet metal 45 approximately the width 30 of the box beam 10. The portion of the second piece of sheet metal 45 extending between the depending side portions 44, 46 comprises the top portion 42 of the U-shaped track 40. The top portion 42 and the depending side portions 44, 46 are configured to receive the top portions 14, 26 of the box beam 10 and/or the bottom portion 18 of the box beam 10, as desired.

The foregoing descriptions are considered illustrative of the principles of the present invention. Because numerous adaptations, modifications and equivalents will readily occur to those skilled in the art, the foregoing descriptions are not intended to the exact construction and operation shown and described, and all such adaptations, modifications and equivalents are intended to fall within the scope of the claims appended hereto:

What is claimed is:

1. A box beam comprising: first and second allowance ends, first and second top portions that are substantially coplanar and spaced apart by a seam, first and second side portions, and a bottom portion; said first allowance end and said first side portion each depending from opposite edges of said first top portion in a substantially common direction at about a right angle to said first top portion; said second allowance end and said second side portion each depending from opposite edges of said second top portion in a substantially common direction at about a right angle to said second top portion; said first side portion extending between said first top portion and said bottom portion and being connected at about a right angle to one end of said bottom portion; said second side portion extending between said second top portion and said bottom portion and being connected at about a right angle to an opposite end of said bottom portion; said bottom portion being generally parallel with said first and second top portions; said bottom portion having a ridge formed therein and raised from said bottom portion generally toward said first and second top portions; wherein said first and second allowance ends are generally parallel and depend in substantially the same direction from said first and second top portions, respectively.

2. The box beam of claim 1 wherein said first and second allowance ends are spaced apart from about 0 inches to about ½ inch.

3. The box beam of claim 1 wherein said box beam is manufactured of sheet metal having desired thickness.

4. The box beam of claim 3 wherein said sheet metal has a gauge thickness from about 10-gauge to about 20-gauge.

5. The box beam of claim 3 wherein said sheet metal comprises cold rolled steel.

6. The box beam of claim 5 wherein said steel is galvanized.

7. The box beam of claim 3 wherein said right angles are formed by a break press that bends one portion respective to an adjacent portion, each bend so formed having an internal radius about 1½ times said thickness of said sheet metal.

8. The box beam of claim 1 wherein said first and second allowance ends and said ridge extend within said box beam substantially along the length of said box beam.

9. The box beam of claim 1 having a width from about 2 inches to about 6 inches.

10. The box beam of claim 1 having a height from about 6 inches to about 16 inches.

11. The box beam of claim 1 wherein said first and second allowance ends depend from said first and second top portions, respectively, a distance from about ¼ inch to about 1 inch.

12. The box beam of claim 1 further comprising a U-shaped track secured to said box beam generally at said first and second top portions and covering said seam.

13. The box beam of claim 12 further comprising a second U-shaped track secured to said box beam generally at said bottom portion and covering said ridge.

14. The box beam of claim 1 further comprising a U-shaped track secured to said box beam generally at said bottom portion and covering said ridge.

15. The box beam of claim 1 further comprising at least one structural element selected from the group consisting of notches, tail cuts, seat cuts and angled butt joints, is incorporated into an end of said box beam or into a medial portion thereof along its longitudinal length.

16. The box beam of claim 1 wherein said ridge comprises a first side and a second side, and an angle between said first and second sides between about 0 degrees and about 85 degrees.

17. The box beam of claim 1 wherein said ridge comprises a first side and a second side each raised from said bottom portion at about right angles thereto and extending to a ridge top connecting said first and second sides at about right angles to each, respectively, said ridge having a width in the plane of said bottom portion up to about 1 inch.

18. A method for fabricating a box beam from sheet metal comprising the steps of: cutting said sheet metal to desired size; forming a ridge along the length of said sheet metal generally midway about the width thereof, said ridge being raised from said sheet metal a distance from about ¼ inch to about 1 inch; turning up opposite ends of said sheet metal at about right angles thereto along the length thereof generally equidistantly, said opposite ends being turned up not more than about 1 inch; turning up first and second top portions adjacent said opposite ends, respectively, at about right angles to said sheet metal, said first and second top portions each being turned up a distance equal to or less than about ½ the width desired for said box beam; turning up first and second side portions adjacent said first and second top portions, respectively, at about right angles to said sheet metal, said first and second side portions being spaced apart along said sheet metal about the width desired for said box beam.

19. The method of claim 18 further comprising the step of cutting at least one of notches, tail cuts, seat cuts, and angled butt joints into said sheet metal.

20. The method of claim 18 wherein said ridge forming step is performed by clamping said sheet metal between a male die positioned on one side of said sheet metal and a female die positioned on an opposite side of said sheet metal.

21. The method of claim 18 wherein said turning up steps are each performed by using a conventional break or roll press generally powered by one of electrical, hydraulic and pneumatic means.

22. The method of claim 18 further comprising steps for fabricating at least one U-shaped track for securing to said box beam, said steps including: selecting a second piece of sheet metal having a length generally the same as the length of said box beam and a width no greater than approximately the desired width for said box beam plus the height of one of said first and second side portions; turning up first and second depending side portions at about right angles to said second piece along the length thereof generally equidistantly, said first and second depending side portions being spaced apart along said second piece approximately the width of said box beam.

23. A box beam comprising: first and second top portions that are substantially coplanar and that have a first inner edge and outer edge and a second inner edge and outer edge respectively, connection means for securing said first and second top portions at said first and second inner edges, said connection means defining a seam therebetween, first and second side portions each being substantially planar along their respective lengths, and a bottom portion; said first side portion depending from said first outer edge at about a right angle to said first top portion; said second side portion depending from said second outer edge at about a right angle to said second top portion; said first side portion extending between said first top portion and said bottom portion and being connected at about a right angle to one end of said bottom portion; said second side portion extending between said second top portion and said bottom portion and being connected at about a right angle to an opposite end of said bottom portion; said bottom portion being generally parallel with first and second top portions; said bottom portion having a ridge formed therein and raised from said bottom portion generally toward said first and second top portions.

24. The box beam of claim 23 wherein said connection means comprises said first and second inner edges being abutted to define said seam, and a welding connection applied substantially along the length of said seam.

25. The box beam of claim 23 wherein said connection means comprises an overlap joint defining said seam, wherein said second top portion comprises a recessed lip extending from said second inner edge, said lip being configured to receive said first inner edge.

26. The box beam of claim 25 comprising a welding connection applied substantially along the length of said overlap joint.

27. The box beam of claim 25 wherein said lip extends from said second top portion at least ½ inch.

28. The box beam of claim 23 wherein said connection means comprises an interlocking tongue and groove joint defining said earn.

29. The box beam of claim 28 wherein said interlocking tongue and groove joint comprises a male tongue and groove end extending from said first top portion at said first inner edge, and a female tongue and groove end extending from said second top portion at said second inner edge.

30. The box beam of claim 29 wherein said male tongue and groove end comprises a first hairpin lip extending downwardly and backwardly beneath said first top portion, said first hairpin lip and said first top portion defining a first groove, said female tongue and groove end comprising a recessed lip extending from said second top portion to a second hairpin lip extending upwardly and backwardly above said recessed lip to define a second groove, said first groove configured to receive said second hairpin lip, said second groove configured to receive said first hairpin lip.

31. The box beam of claim 30 wherein said first and second hairpin lips respectively extend at least about ½ inch.

* * * * *